United States Patent [19]

Shelby et al.

[11] 4,338,890

[45] Jul. 13, 1982

[54] HOOD, MUFFLER AND AIR CLEANER MODULE FOR AN INTERNAL COMBUSTION ENGINE

[75] Inventors: Robert L. Shelby, Chillicothe; Douglas A. Wilkins, Wyoming, both of Ill.

[73] Assignee: Caterpillar Tractor Co., Peoria, Ill.

[21] Appl. No.: 220,711

[22] Filed: Dec. 29, 1980

Related U.S. Application Data

[63] Continuation of Ser. No. 72,260, Jan. 31, 1979, abandoned.

[51] Int. Cl.[3] ..... F02B 77/00

[52] U.S. Cl. ..... 123/195 A; 123/195 C; 123/198 E; 181/204; 180/69 R; 180/89.17

[58] Field of Search ..... 123/195 R, 195 A, 195 C, 123/198 E; 181/204; 180/69 R, 54 A, 89.17

[56] References Cited

U.S. PATENT DOCUMENTS

| | | | |
|---|---|---|---|
| 3,856,439 | 12/1974 | Moehrbach | 181/204 |
| 4,011,849 | 3/1977 | Latham | 123/198 E |
| 4,122,353 | 10/1978 | Noguchi | 181/204 |
| 4,133,547 | 1/1979 | Fox | 180/54 A |
| 4,141,334 | 1/1979 | Hatz et al. | 123/198 E |
| 4,149,512 | 4/1979 | Hatz | 123/198 E |

*Primary Examiner*—Craig R. Feinberg

*Attorney, Agent, or Firm*—Stellman, McCord, Wood & Dalton

[57] ABSTRACT

A hood (12) for an internal combustion engine compartment (C) has an air precleaner (10) and a muffler (11) mounted on the underside of the hood (12). The collar (26) connecting the precleaner (10) to the engine air intake (M1), and the pipe (36) from the exhaust manifold (M2) to the muffler (11) are both connected by means (26b, 37) which are releasable with the hood (12) in position, so the hood (12), precleaner (10) and muffler (11) constitute a removable module.

6 Claims, 5 Drawing Figures

45
17
41
39
29
C2
30
27
28
12
15
11
29
31
35
18
13
16
40
42
36
38
37
C1
M1
M2
D
C

HOOD, MUFFLER AND AIR CLEANER MODULE FOR AN INTERNAL COMBUSTION ENGINE

This is a continuation of application Ser. No. 72,260 fild Jan. 31, 1979, now abandoned.

TECHNICAL FIELD

This invention relates to a hood, muffler and precleaner module which may be removed as a unit from a position surmounting an internal combustion engine compartment.

BACKGROUND ART

Large internal combustion engines such, for example, as the diesel engines used in heavy vehicles, commonly have a combustion air precleaner and an exhaust system muffler mounted above the engine so they must be removed before certain types of service on the engine can be performed.

It has been common for the muffler to be mounted on brackets surmounting the engine, so that the muffler brackets often had to be removed.

DISCLOSURE OF THE INVENTION

The present invention is directed to overcoming one or more of the problems as set forth above.

According to the present invention, a compartment for an internal combustion engine which has an exhaust system having a manifold and having a muffler above the engine is provided with a hood which is detachably mounted on the compartment in a position spaced above the engine. A muffler for the exhaust system is mounted on the underside of the hood and has an exhaust intake pipe which is detachably connected to the manifold by releasable means which is constructed and arranged to be released with the hood in position, so that the hood and the muffler constitute a removable module.

BEST MODE FOR CARRYING OUT THE INVENTION

Figure 1:
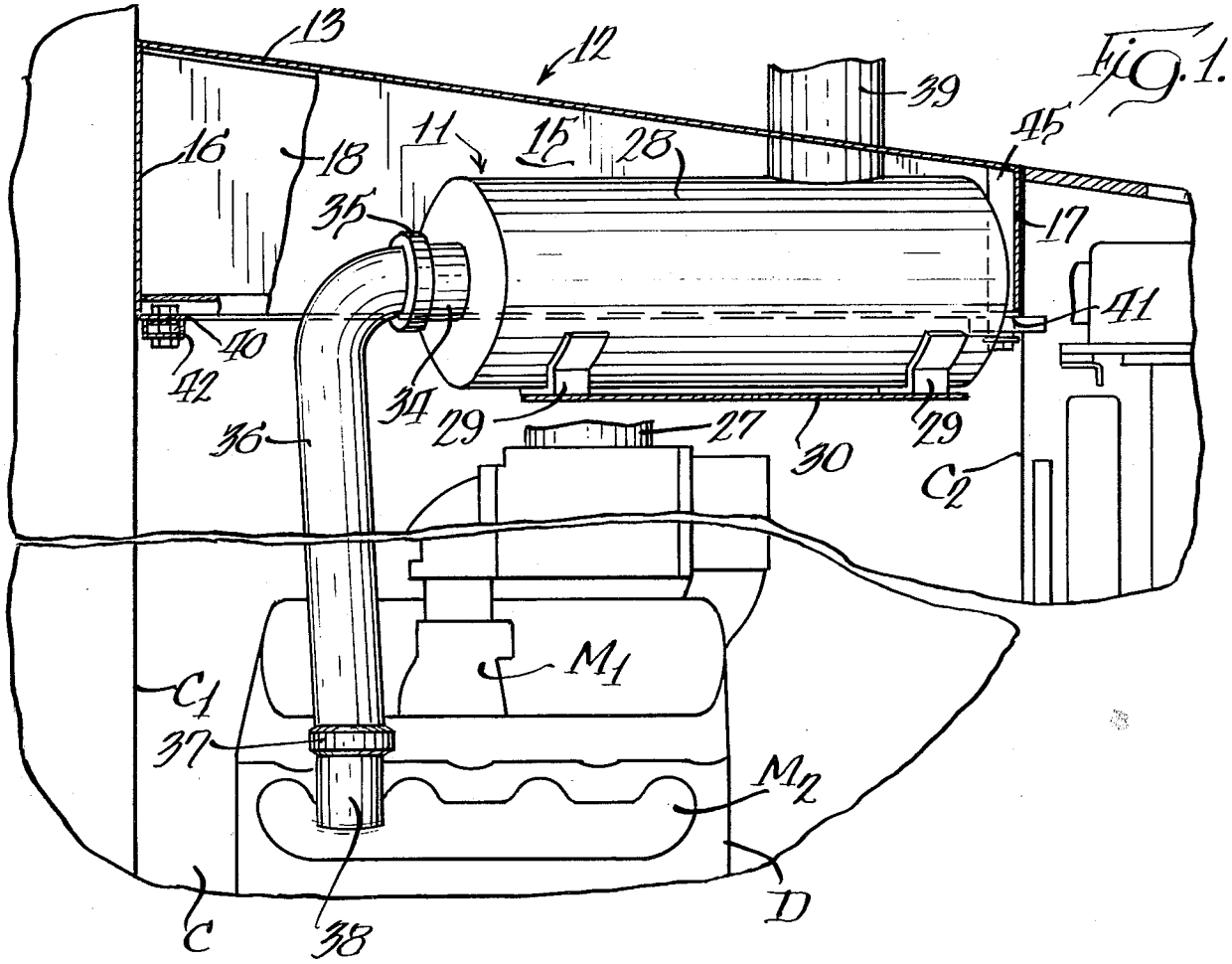
FIG. 1 is a longitudinal, vertical sectional view of the apparatus of the invention, with parts broken away, taken substantially as indicated along the line I—I of FIG. 3 with an internal combustion engine with its intake and exhaust manifolds diagrammatically shown.

Referring to the drawings, C is an engine compartment of a heavy vehicle such, for example, as a track laying tractor, and is defined by a rear wall C1 and a front frame C2. An internal combustion engine such as a high horsepower diesel engine D is mounted in the engine compartment C and is equipped with the usual intake manifold M1 and exhaust manifold M2. The present invention is directed to the mounting of a combustion air precleaner, indicated generally at 10, and an exhaust muffler, indicated generally at 11, both of which are usual and normal accessory devices for an internal combustion engine.

A hood, indicated generally at 12, is defined by a top wall 13 and side walls 14 and 15 upon which are mounted respective external handrails **14*a* and 15*a*. A rear wall 16 and a front wall 17 complete the perimeter of the hood, while a longitudinal central partition 18 divides it into an air cleaner compartment 19 and a muffler compartment 20**.

The intake air precleaner 10 includes an annular shell 21 having a circumferential flange 22 secured thereto as by welding or riveting. Brackets 23 and 24 welded, respectively, to the hood side wall 14 and the partition 18 provide a mounting to which the flange 22 is detachably secured. The air precleaner 10 has an air delivery throat 25 at its lower end, and a connecting collar 26 is detachably secured to the throat 25 and to an air delivery duct 27 by means of removable clamps **26*a* and 26*b***.

The exhaust muffler 11 has a casing 28 to the lower surface of which a pair of mounting members 29 are welded. An upwardly open box-like bracket 30 has out-turned mounting flanges 31, and mounting bolts **31*a* extend through said flanges and through mating webs 32 and 33 which are integral, respectively, with the side wall 15 and the partition 18 of the hood. The mounting members 29 on the muffler are detachably secured to the box-like bracket 30 by means of bolts and nuts 29*a*, so the muffler may be easily replaced or serviced by unfastening the bolts 31*a* and 29 *a***.

An annular connecting stub 34 at one end of the muffler casing 28 receives a first collar 35 by means of which an exhaust connecting pipe 36 communicates with the interior of the muffler casing 28; and at a lower end of the connecting pipe 36 is a second collar 37 by means of which the connecting pipe is detachably connected to the outlet 38 of the exhaust manifold M2. The collars 35 and 37 are both of a readily manually detachable type.

An exhaust stack 39 surmounts the muffler casing 28 and extends through a complementary opening in the hood top wall 13.

Figure 2:
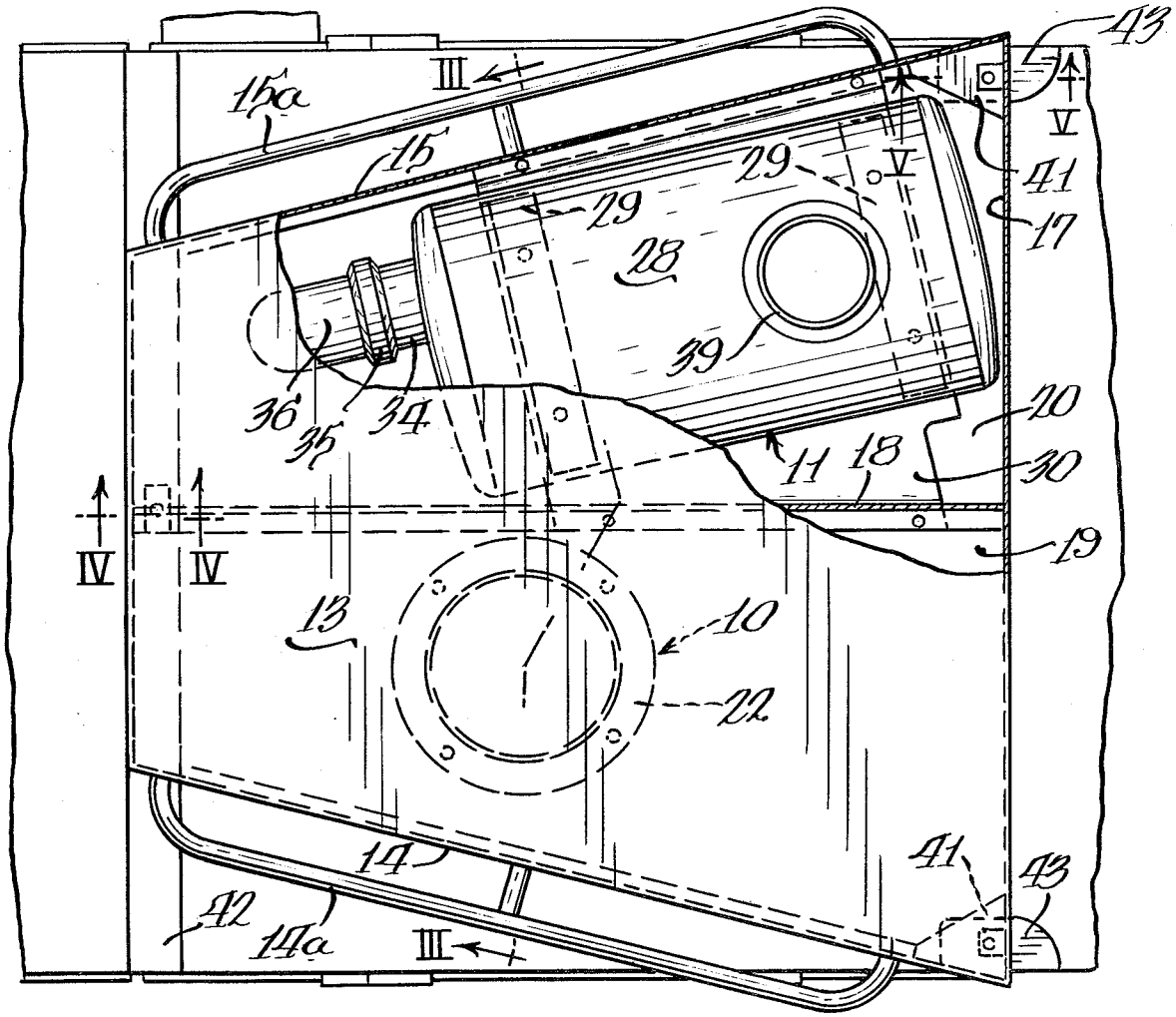
FIG. 2 is a fragmentary plan view of a heavy vehicle equipped with the apparatus of the invention with parts broken away.
Figures 3, 4, 5:
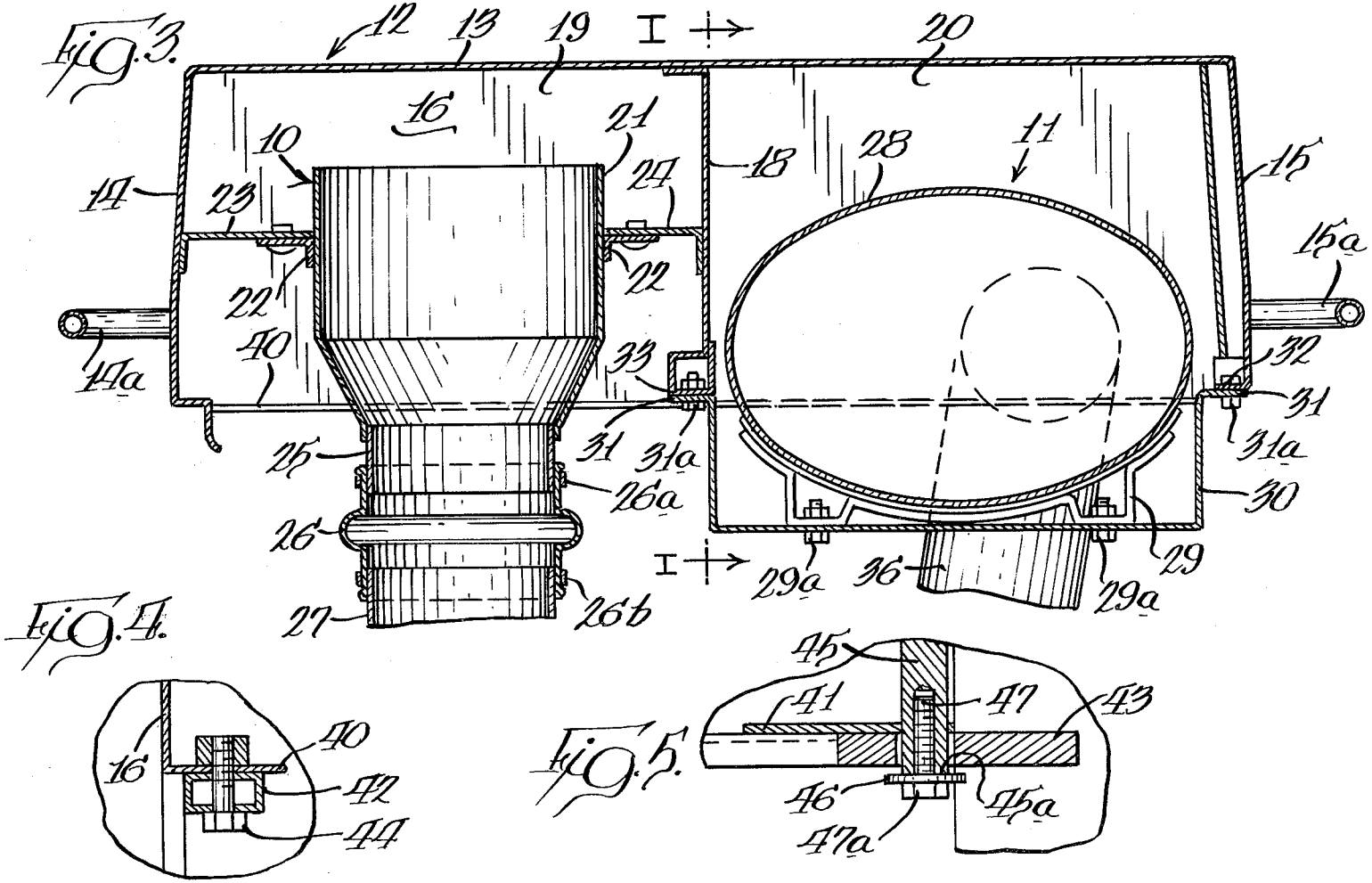
FIG. 3 is a transverse vertical sectional view taken substantially as indicated along the line III—III of FIG. 2.
FIG. 4 is a fragmentary sectional view on an enlarged scale taken substantially as indicated along the line IV—IV of FIG. 2.
FIG. 5 is a fragmentary sectional view on an enlarged scale taken substantially as indicated along the line V—V of FIG. 2.

The hood 12 has a rear horizontal web 40 which extends across the lower margin of the rear wall 16, and a pair of gussets 41 which occupy the front outer corners between the front wall 17 and the side walls 14 and 15. The web 40 rests upon a box flange 42 at the rear of the engine compartment C. As seen in FIGS. 2 and 4, a single center bolt 44 engages the box rail 42 and the flange 40 to anchor the rear of the hood 12. As best seen in FIG. 5, the front corners of the hood are provided with fixed studs which extend through the gussets 41 and the tabs 43 and have threaded bores. The studs have lower ends **45*a* below the tabs. Washers 46 bear on the stud ends 45*a*, and mounting bolts 47 which screw into the studs have heads 47*a* abutting the washers. The relationship between the studs 45, the tabs 43, the washers 46 and the bolts 47 allows for limited vertical and horizontal movement of the hood gussets 41 relative to the tabs 43**.

INDUSTRIAL APPLICABILITY

In practice, the hood 12 with the combustion air precleaner 10 and the muffler 11 detachably mounted therein provides a module which may be positioned atop the engine compartment with the flange 40 resting upon the rail 42 and the gussets 41 resting upon the tabs 43, and which may then be firmly fixed in place by means of the bolt 44 and the threaded fasteners 45. The clamp **26*b* is then tightened to firmly secure the collar 26 to the air intake throat 27; and the second collar 37 is similarly secured to the exhaust manifold outlet 38. All that is needed to remove the module is to release the clamp 26*b* and the collar 37, remove the bolt 44 and the threaded fasteners 45**, and lift the entire module off the engine compartment C. This offers full access to the compartment C for doing any necessary work upon the engine D.

When it becomes necessary to install a new muffler, the module is removed as heretofore described, the bolts **31*a* are removed to dismount the bracket 30, and the bolts 29*a* are then removed to detach the muffler 11 from the bracket 30 and replace it with a new one. Similarly, the air cleaner 10 may be separated from the hood 12 by removing the fasteners by which the flange 22 is secured to the brackets 23 and 24**.

Other aspects, objects and advantages of this invention can be obtained from a study of the drawings, the disclosure and the appended claims. The foregoing detailed description has been given for clearness of understanding only and no unnecessary limitations should be understood therefrom as modifications will be obvious to those skilled in the art.

We claim:

1. In an upwardly open compartment (C) for an internal combustion engine (D) with an exhaust system having a manifold (M2) and having a muffler (11) above the engine (D), the improvement comprising:

a hood (12) detachably mounted on the compartment (C) in a position spaced above the engine (D), said hood providing a top closure for said compartment;

a muffler (11) for the exhaust system which has an exhaust intake pipe (36);

means (29, **29*a*, 30, 31, 31*a*) secured to the hood (12) supporting the muffler (11) onto the underside of the hood (12**);

and releasable means (37) detachably connecting the exhaust intake pipe (36) to the manifold (38-M2), said releasable means (37) being constructed and arranged to be released with the hood (12) in position, wherein the hood (12), supporting means and muffler (11) constitute a module means removable from the upwardly open compartment (C) as a unit to leave the internal combustion engine (D) completely accessible from above.

2. The improvement of claim 1 in which the means supporting the muffler (11) onto the hood (12) comprises bracket means (30,31) detachably mounted on the hood, and means (29,**29*a*) securing the muffler (11) to said bracket means (30,31**).

3. The improvement of claim 2 in which the means (29,**29*a*) supporting the muffler (11) onto the hood (12) comprises mounting members (29) on the muffler (11) and means (29*a*) detachably securing the mounting members to the brackets (30,31**).

4. In an upwardly open compartment (C) for an internal combustion engine (D) with an exhaust system having a manifold (M2) and having a muffler (11) above the engine (D), and having a combustion air precleaner (10) for the engine air intake manifold (M2), the improvement comprising:

a hood (12) detachably mounted on the compartment (C) in a position spaced above the engine (D), said hood providing a top closure for said compartment;

a muffler (11) for the exhaust system which has an exhaust intake pipe (36);

means (29, **29*a*, 30, 31, 31*a*) secured to the hood (12) supporting the muffler (11) onto the underside of the hood (12**);

first releasable means (37) detachably connecting the exhaust intake pipe to the manifold, said first releasable means (37) being constructed and arranged to be released with the hood (12) in position;

an air precleaner (10) which has an air delivery collar (26) connected to the engine air intake manifold (M1);

means (22,23,24) secured to the hood (12) supporting the precleaner (10) onto the underside of the hood 12;

and second releasable means (**26*b*) detachably connecting said air delivery collar (26) to the engine air intake manifold (M1), said second releasable means (26*b*) being constructed and arranged to be released with the hood (12) in position, wherein the hood (12), muffler (11), muffler supporting means, precleaner (10**) and precleaner supporting means constitute a module means removable from the upwardly open compartment (C) as a unit to leave the internal combustion engine (D) completely accessible from above.

5. The improvement of claim 4 which includes a generally upright depending partition (18) on the underside of the hood which divides the hood into an air cleaner compartment (19) and a muffler compartment (20).

6. The improvement of claim 5 in which the means (29,**29*a*,30,31,31*a*) supporting the muffler (11) onto the hood (12) and the means (22,23,24) supporting the air precleaner (10) onto the hood both include parts secured to the partition (19**).

* * * * *